United States Patent [19]

Bione

[11] 4,046,048

[45] Sept. 6, 1977

[54] DIGITAL TOUCH RESPONSIVE TEMPO GENERATING DEVICE

[75] Inventor: Angelo A. Bione, Chicago, Ill.

[73] Assignee: Hammond Corporation, Chicago, Ill.

[21] Appl. No.: 699,329

[22] Filed: June 24, 1976

[51] Int. Cl.[2] ..... G10F 1/00

[52] U.S. Cl. ..... 84/1.03; 84/1.28

[58] Field of Search ..... 84/1.01, 1.03, 1.17, 84/1.24, 1.28, 478

[56] References Cited

U.S. PATENT DOCUMENTS

| | | | |
|---|---|---|---|
| 3,629,481 | 12/1971 | Bunger | 84/1.03 |
| 3,811,003 | 5/1974 | Harris | 84/1.03 |
| 3,837,256 | 9/1974 | Gullickson | 84/1.03 |
| 3,840,901 | 10/1974 | Okamoto | 84/1.03 |
| 3,865,001 | 2/1975 | Hershey | 84/1.03 |

*Primary Examiner*—Robert K. Schaefer
*Assistant Examiner*—Vit W. Miska
*Attorney, Agent, or Firm*—Neuman, Williams, Anderson & Olson

[57] ABSTRACT

The present invention is directed to a digital touch responsive tempo generating device for use in an electronic musical instrument, preferably an electronic organ. The instrument player selects a desired tempo to control a standard rhythm unit or other circuit either before or during playing by repetitively actuating a touch plate at a rate corresponding to the desired tempo. A digital value related to the time interval between predetermined repetitive touches by the instrument player is stored in a digital circuit having a memory under control of a clock circuit. A tempo generator circuit coupled to the digital circuit produces tempo output pulses spaced apart as a function of the time interval between the repetitive touches.

12 Claims, 2 Drawing Figures

DIGITAL TOUCH RESPONSIVE TEMPO GENERATING DEVICE

BACKGROUND OF THE INVENTION

The present invention is directed to a tempo generating device for an electrical musical instrument, such as an electronic organ. In playing the organ, the organist desires to control the tempo at which automatic accompaniment and rhythm devices which have become commonplace in electronic organs provided an audio output. A standard type of rhythm unit provides a plurality of different audio output signals or voices such as bass drums, cymbals or others which are selectable by the player. The output signals of the rhythm unit occur in a predetermined and repeated pattern such as a waltz or others also selectable by the player. The tempo of the rhythm unit is the frequency or time interval at which the predetermined pattern is repeated.

In a previously used device, the instrument player selects a desired tempo by controlling a variable resistor circuit. By changing the resistance value of this circuit, the voltage level of its output signal varies and is used to adjust the frequency output of a voltage controlled oscillator. The output of the oscillator provides a tempo signal to control the repetition rate of the rhythm unit. In this type of device, the player estimates the tempo output based upon the position of a variable resistor knob or lever. No time relationship or correlation exists between the desired tempo and the movement of the indication knob of the variable resistor. The player has to listen to the audio signal being produced by the rhythm unit and thereafter adjusts the variable resistor until the desired tempo is achieved. Such a device is cumbersome to regulate and disturbing to an audience or other musicians in the surrounding area. Furthermore, the selection of an appropriate new tempo during play is particularly difficult.

An improvement over the variable resistor tempo device is the touch responsive device described in United States patent application for a Tempe Setting Device For An Automatic Rhythm Instrument, Ser. No. 585,403 by Masashi Shibahara. To select a desired tempo, the instrument player taps a touch plate a predetermined number of times at the desired tempo. The time interval between two predetermined and consecutive taps produces an analog voltage level at a magnitude related to the time interval. The analog voltage signal is applied as the input control signal to a voltage controlled oscillator. The oscillator provides a tempo output signal at an inerval related to the magnitude of the input analog signal in the same manner described with respect to the variable resistor tempo setting device. This touch responsive device establishes a positive time link or connection between the instrument player's desired tempo and the setting device. However, the voltage controlled oscillator is still necessary to produce a tempo signal in response to the variable level analog voltage signal in the same manner as in the variable resistance devices.

The present invention overcomes the difficulties and disadvantages of the known tempo setting devices by providing a digital device in which the instrument player selects a desired tempo by repetitively tapping a touch plate a predetermined number of times. Each tap by the player produces a touch pulse signal which controls the operation or mode of subsequent logic circuitry. In one mode, a digital value corresponding to the time interval between predetermined repetitive taps is stored in a digital circuit having a memory under control of a timing signal from a clock circuit. In a second mode, the stored digital value is read-out from the memory circuit under the control of a timing signal from the clock circuit. A tempo generator circuit is responsive to the completion of the read-out cycle and produces a tempo pulse output signal. The tempo generator circuit also provides a reset signal to the memory circuit to repeat the read-out cycle. The output pulses from the tempo generator are spaced apart as a function of the time interval between the predetermined repetitive taps by the instrument player.

SUMMARY OF THE INVENTON

The present invention is directed to a digital touch responsive tempo generating device for an electronic musical instrument, preferably an electronic organ. The instrument player controls the tempo at which an automatic acompaniment or rhythm unit produces a predetermined pattern of output signals or voices. The instrument player taps or quickly touches a capacitive touch plate at the desired tempo. In response, a tempo signal is produced at the output of the tempo generating device at a time interval which is functionally related to the time duration between two predetermined repetitive taps and which controls the periodicity of the rhythm unit.

Each tap by the instrument player produces a touch pulse signal which controls the state of succeeding digital logic circuitry in the tempo generating device. The first touch pulse signal resets an up-down or reversible counter circuit and energizes a timed reset circuit. If the second touch pulse occurs within a predetermined time interval, it restarts the timed reset circuit. If the second touch pulse is not received within the predetermined time interval, the tempo generating device is reset and the tap sequence by the instrument player must be repeated. The second touch pulse also places the reversible counter circuit in the up-count mode and energizes a logic control circuit. The control circuit passes a timing signal from clock circuit to sequence the reversible counter circuit. The third touch pulse again restarts the timed reset circuit. The third touch pulse also deactivates the logic control circuit so that no further timing signals are passed to the reversible counter circuit. The third touch pulse causes the value of the count produced by the reversible counter circuit to be stored in a memory circuit and places the reversible counter in the count-down mode. The fourth touch pulse de-energizes the timed reset circuit. It also energizes the logic control circuit to pass a timing signal to sequence the reversible counter circuit. When the reversible counter circuit now in the count-down mode unloads or empties, it provides a signal to a tempo generator circuit. The tempo generator circuit provides a signal to reload the reversible counter to the same value reached during the interval between the second and third touch pulses which is stored in the memory circuit. The tempo generator circuit also energizes the logic control circuit to pass a timing signal from the clock circuit to the counter circuit causing it to again count-down. The frequency of this timing signal can be the same or a multiple of the frequency of the timing signal used to load the counter during the time interval between the second and third touch pulses. The tempo generator circuit further produces a tempo output pulse each time the reversible counter reaches its empty state. Thus, the output pulses are provided at a time interval functionally related to the time interval between the second and third touch pulses. No external oscillator is necessary in this digital touch responsive system. The time interval between the output signal pulses is under the control of the clock circuit used to load the reversible counter during the time interval between the second and third touch pulses.

An object if the present invention is to provide a digital touch responsive tempo generating device which provides a tempo output signal at a time interval functionally related to the time interval between predetermined repetitive touches by an instrument player.

Other objects of the present invention will become apparent by examination of the following detailed description and drawings in which.

DETAILED DESCRIPTION

Figure 1:
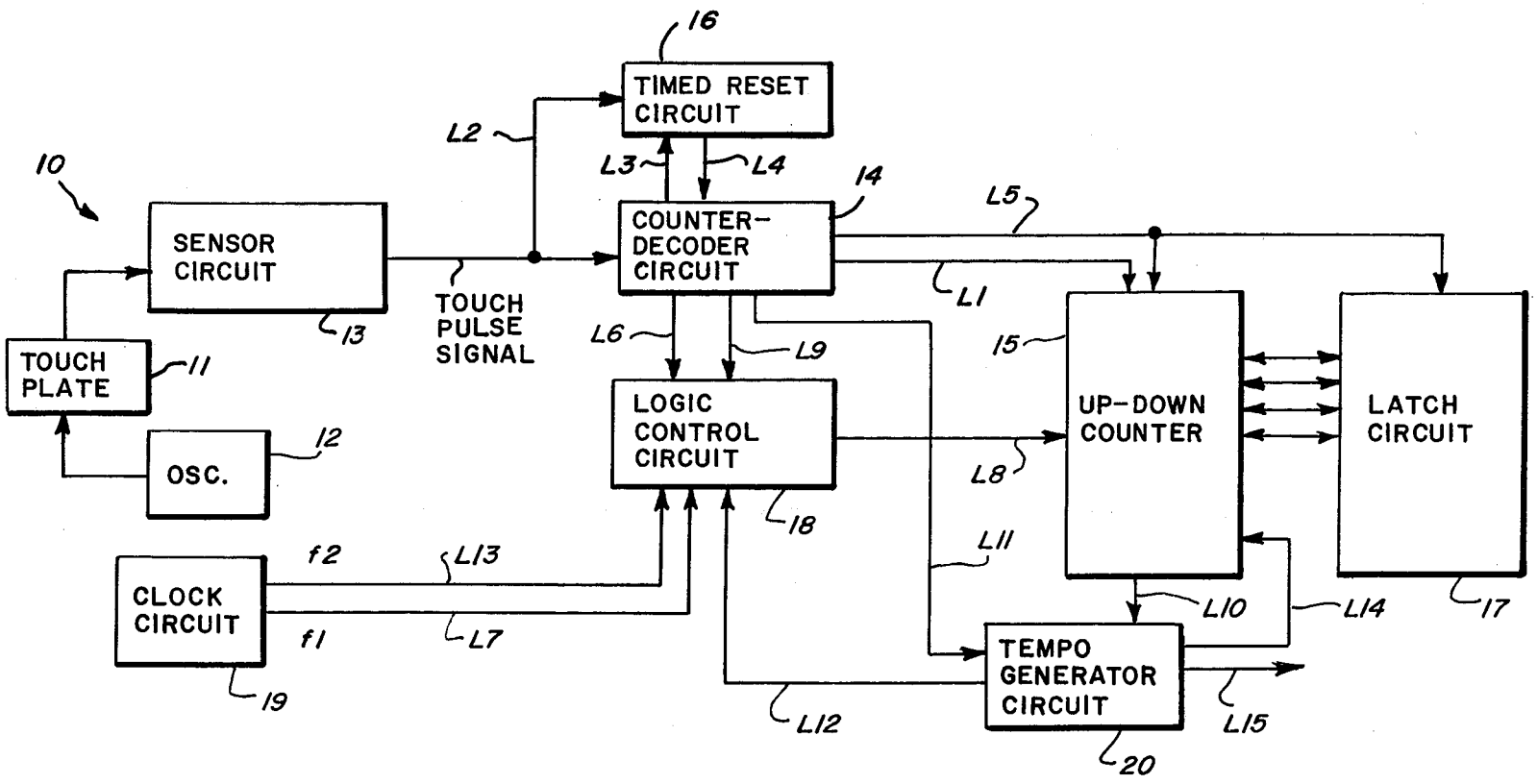
FIG. 1 illustrates diagrammatically the digital touch responsive tempo generating device.

FIG. 1 illustrates in block diagram form the tempo generating device of the present invention. When a player of a musical instrument, such as an electronic organ desires to control the tempo of a circuit such as the rhythm unit he taps or touches a touch plate a number of times. The time interval between two selected consecutive taps corresponds to the desired rhythm. The tempo generating device of the present invention produces an output pulse signal in which the interval between consecutive pulses is a function of the desired tempo. The tempo generating device will continue to provide output pulses to control the rhythm unit or other accompaniment circuitry until reset.

If the instrument player desires to control a tempo, he repetitively actuates the touch detector circuit 10 comprising touch plate 11, oscillator circuit 12 and sensor circuit 13. The output of oscillator 12 is connected to the touch plate 11. When unactuated, the touch plate 11 passes the oscillator output signal substantially unaltered tothe touch sensor 13. In this condition, the output of sensor circuit 13 is in the quiescent state. When the player taps the touch plate 11, the signal produced by oscillator 12 is attenuated. The sensor circuit 13 detects the change in its input signal and produces a pulse output. The touch plate output signals from the sensor circuit 13 control the state or mode of operation of the remaining circuitry.

The touch pulses are received by a digital memory circuit including the counter-decoder circuit 14. The counter-decoder circuit 14 counts the occurrence of each touch pulse signal and through associated logic gates decodes the number of touch pulses received into a plurality of operation signals. The first pulse received by the counter-decoder circuit 14 produces a signal on line L1 which resets the binary up-down counter 15. Each touch pulse signal is also applied to a timed reset circuit 16 on line L2. The counter-decoder circuit 14 upon the occurrence of the first touch pulse also produces a signal on line L3 to activate the reset circuit 16. If a second touch pulse is not received by the reset circuit 16 within a predetermined time period, the reset circuit produces a signal on line L4 to reset the counter-decoder circuit 14.

The second touch pulse from sensor circuit 13 is received by the counter-decoder circuit 14. The second touch pulse is also received by reset circuit 16 on line L2 to restart the timing circuit and prevent it from generating a reset signal on line L4. The counter-decoder circuit 14 continues to provide a signal on line L3 for energizing the reset circuit 16. The counter-decoder circuit 14 now produces an output on line L5 to place reversible counter 15 in the up-count state and to place latching or memory circuit 17 in the receiving state. The counter-decoder circuit 14 also produces an output on line L6 to open logic control circuit 18. The control circuit 18 receives an input clocking at a frequency F1 on line L7 from the clocking circuit 19. The clocking signal is passed to the counting input of up-down counter 15 on line L8. Thus, the up-down counter 15 begins to count up with the receipt of each clocking or timing pulse on line L8.

Upon occurrence of the third touch pulse, the counter-decoder circuit removes the signal on line L6 to close the logic control circuit 18. Thereafter, the clocking signal on line L7 is not passed to the counting input of reversible counter 15. The third touch pulse on line L2 restarts the timing circuit of the reset circuit 16. The counter-decoder circuit 14 also produces a signal on line L5 which places the reversible counter in the count-down state and closes the latching circuit 17. The value of the count made by reversible counter circuit 15 is stored in latching circuit 17. The counter-decoder circuit 14 continues toprovide a signal on line L3 to energize circuit 16.

Upon receipt of the fourth touch pulse, the counter-decoder circuit 14 provides a signal output on line L9. The reset circuit 16 also receives the fourth touch pulse on line L2 to restart the reset timing circuit, but the counter-decoder circuit 14 does not energize the reset circuit 16 via line L3 as was done upon the occurrence of previous touch pulses. The signal on line L9 opens logic control circuit 18 to pass the clocking signal L7 to the counting input of reversible counter 15 via line L8. The reversible counter 15 counts down until it reaches its empty state. Upon reaching the empty state, reversible counter 15 provides a signal on line L10 to tempo generator circuit 20. The occurrence of the fourth pulse causes counter-decoder 14 to produce an output to the tempo generator circuit 20 on line L11. Upon receiving the signals on both line L10 on line L11, the generator circuit 20 produces a signal on line L12. The signal on line L12 closes the logic control circuit 18 to the clocking signal on line L7 from clock circuit 19 and opens logic control circuit 18 to the clocking signal at a frequency F2 on line L13 from clock circuit 19. Also, generator circuit 20 produces a signal on line L14 to reload the reversible counter 15 to the value previously stored in latching circuit 17. Thus, for succeeding operations, the clocking signal on line L13 will cause the reversible counter 15 to count down to its empty state. Also, the tempo generator circuit 20 produces a pulse output signal on line L15 each time reversible counter 15 empties. The pulse output on line L15 occurs at an interval which is a multiple of the time interval between the second and third touch pulses. The multiple is the same as the multiple relation between the frequency of the signal on line L7 and line L13. It is apparent that any value multiple could be chosen including 1. The multiple makes the pulse output signal on line L15 compatible with subsequent standard organ circuitry. The pulse output signal on line L15 is produced under the control of the same clock circuit 19 which determines the duration between the second and third touch pulses and consequently the value of the count of reversible counter 15.

The tempo generating device will continue to provide a pulse output signal at an interval functionally related to the desired tempo until reset. To reset the tempo device, the instrument player taps the touch plate 11 and the sensor 13 produces the fifth touch pulse signal. The fifth touch pulse is received on line L2 by reset circuit 16 which provides an output on line L4 to reset the counter-decoder circuit 14. The tempo generating device is now ready to receive another sequence of taps from the instrument player to set another tempo.

Figure 2:
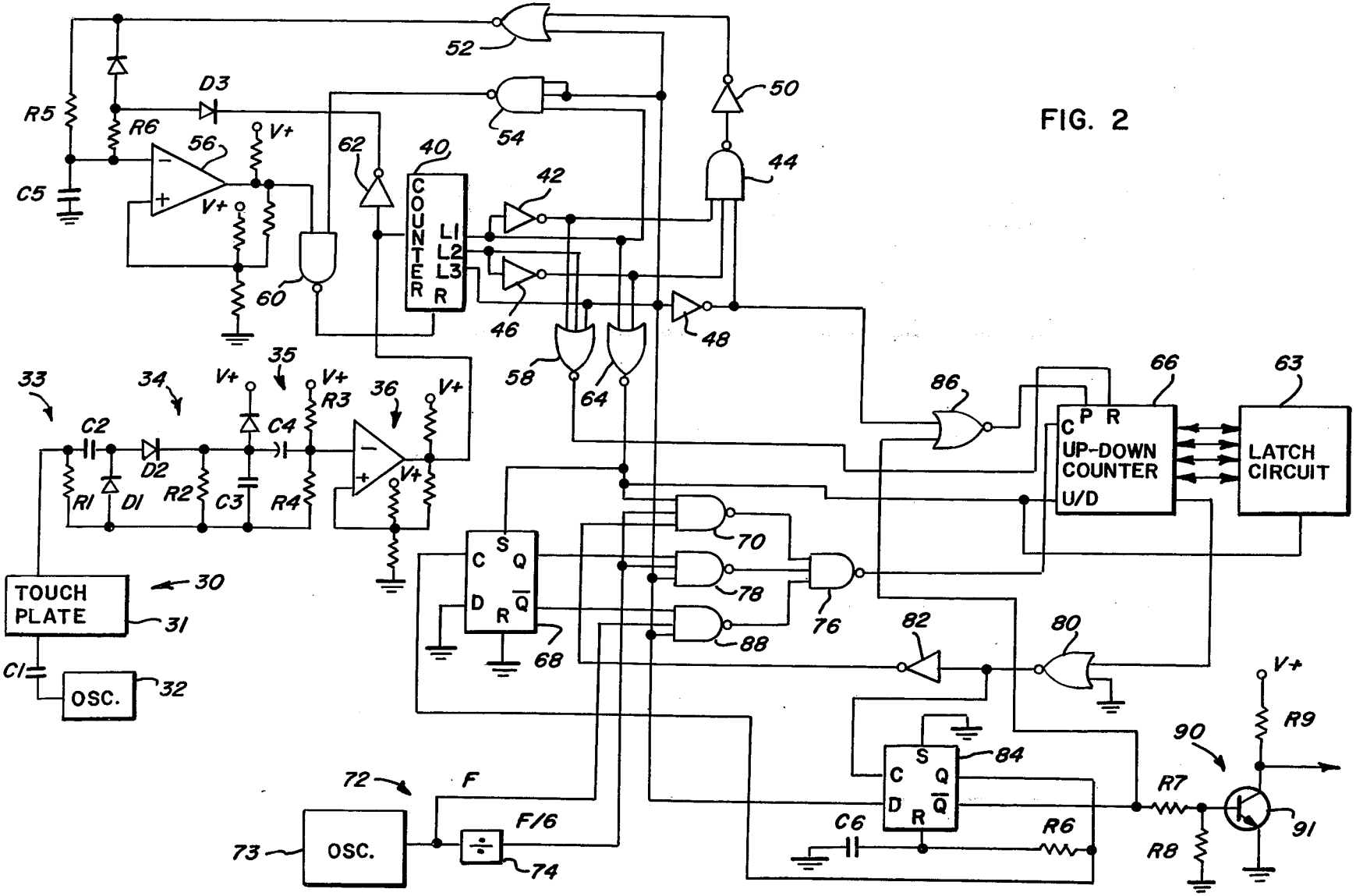
FIG. 2 illustrates schematically the preferred embodiment of the digitial touch responsive tempo generating device.

FIG. 2 illustrates the preferred embodiment of the tempo generating device. When an instrument player desires a specific tempo for an electronic musical instrument, such as an electronic organ, he repetitively taps or actuates switch means 30. In the preferred embodiment, the switch means 30 is a capacitive touch plate 31 and the associated capacitor C1. However, other switching devices well-known in the art could be used. The number of taps on the switch means 30 necessary to establish the desired tempo output is a matter of design choice. The tempo setting device of the present invention operates on four taps and a fifth tap for system reset. Each of the five taps establish a distinct state or mode of operation in the system's circuitry, fully described hereinafter. The time interval between the second and third tap will correspond to the tempo output.

The instrument player is able to select a desired tempo before he begins to play or while he is in the process of playing with the tempo device already providing a tempo output signal. The instrument player selects a desired tempo in either situation by repetitively tapping the switch means 30.

By tapping the capacitive touch plate 31, a large capacitance, much greater than the capacitance of C1, is inserted in shunt between the oscillator 32 and the filter 33. The large shunt capacitance resulting from the instrument player tapping the touch plate 31 attenuates the amplitude of the signal output from oscillator 32. The filter 33 comprising the resistor R1 and the input network capacitance rejects the 60 Hz. signal imposed due to the touch of the instrument player. The filtered signal is passed to the input of peak-to-peak detector 34. The detector 34 comprising diodes D1 and D2, resistor R2 and capacitors C2 and C3 rectifies the filtered AC signal to provide a DC level voltage signal. The rectified signal is passed through differentiator 35 comprising resistors R3 and R4 and capacitor C4. The differentiator 35 provides a DC voltage signal to the pulse generator 36 representative of the change in DC signal level due to the insertion of the large capacitance by the touch plate actuation. The pulse generator 36 comprises a Schmitt trigger circuit which produces an output pulse of approximately V+ volts for each actuation of the touch plate 31.

The DC voltage level at the inverting input to the Schmitt trigger is normally at a voltage VA, determined by the voltage division or resistors R3 and R4. Upon receipt of the lower DC voltage level signal due to the touch plate actuation, the voltage at the junction between resistors R3 and R4 falls to a lower voltage VB. The other input of the Schmitt trigger is normally at a voltage VC which is between the voltages VA and VB. When the voltage at the inverting input falls below voltage VC, the Schmitt trigger provides a pulse output signal of approximately V+ volts. Also, the voltage at the other input to the Schmitt trigger raises up from voltage VC to a voltage VD, which is closer to, but still less than, voltage VA. The pulse at the output of the Schmitt trigger will remain at V+ volts until the voltage at the inverting input raises from voltage VB to voltage VD. When the voltage at the inverting input raises past voltage VD, the output of the Schmitt trigger will return to its previous state. The resistors illustrated in association with the Schmitt trigger provide a standard voltage division function well-known in the art. Thus, for each tap of the touch plate 31, the pulse generator 36 produces an output pulse.

The first tap of capacitor plate 31 produces a touch pulse signal to the input of counter 40. The counter 40 is a well-known binary type counter which changes its output state upon the occurrence of each input pulse. Counter 40 has three output lines, L1, L2 and L3, which change from logic state 0 to logic state 1 as the counter receives the touch pulses from the pulse generator 36. Before the player selects any tempo, the counter output of lines L1 to L3 are in the 0 0 0 logic state respectively. Upon receipt of the first touch pulse, the counter output lines L1 to L3 change to the 1 0 0 logic state respectively. The second touch pulse changes counter output lines L1 to L3 to the 0 1 0 logic state respectively. The third touch pulse changes the counter output lines L1 to L3 to the 1 1 0 logic state respectively. The fourth touch pulse changes counter output lines L1 to L3 to the 0 0 1 logic state respectively. The fifth touch pulse changes counter output lines L1 to L3 to the 1 0 1 logic state respectively. The counter output lines L1 to L3 are coupled to a plurality of logic gates forming a decoder network.

Upon the occurrence of the first touch pulse, referred to a set pulse, the counter 40 provides a 1 0 0 logic on lines L1 to L3. The logic 1 signal on line L1 is passed through inverter 42. Inverter 42 is a standard NOR logic gate with one input lead tied to ground. The logic gates referred to hereinafter as NAND and NOR gates are well-known in the art and further description is unnecessary. It is to be understood that one of ordinary skill in the art can interchange specific logic gate functions with appropriate modifications of the remaining circuitry. The output of inverter 42 is applied as an input signal to NAND gate 44. The logic 0 signal on line L2 is passed through inverter 46, the output of inverter 46 is applied as an input to NAND gate 44. The logic 0 signal on line L3 is passed to inverter 48. The output of inverter 48 is applied as an input signal to NAND gate 44. Thus, the output of NAND gate 44 will be in the 1 logic state as long as any input from inverters 42, 46 or 48 is in the 0 logic state.

The output of NAND gate 44 is in the 1 logic state for the first through fourth touch pulses. The output of NAND gate 44 is passed through inverter 50 and applied as the first input to NOR gate 52. The second input to NOR gate 52 is from counter output line L3. Thus the output of NOR gate 52 is in the 1 logic state for the first, second and third touch pulses.

The counter output line L1 is also connected to the first input of NAND gate 54. The counter output line L3 is connected to the second and third input of NAND gate 54. The output of NAND gate 54 is in the 1 logic state for all touch pulses except touch pulse five.

The output of NOR gate 52 and the output NAND gate 54 and the touch pulse directly control the automatic reset circuit. Thus the first touch pulse drives the output of NOR gate 52 to the 1 logic state. The output of NOR gate 52 is applied via resistor R5 to charge capacitor C5. The capacitor C5 is connected to the inverting input of Schmitt trigger 56. The output of Schmitt trigger 56 is normally at V+ volts or a 1 logic state. The output of the Schmitt trigger 56 is applied as the first input to the NAND gate 60, which provides an OR gate function. The second input to NAND gate 60 is the output of NAND gate 54. The output of NAND gate 60 is connected to the reset input of counter 40. For touch pulses 1 through 4, the second input to NAND gate 60 is in the 1 logic state from NAND gate 54. Now, after the first touch pulse, the capacitor C5 begins to charge and the touch pulse input from pulse generator 36 to inverter 62 is at a 0 logic state. The output of inverter 62 is at a 1 logic state. If the touch plate 31 is not actuated within the time interval necessary for the capacitor C5 to charge to a voltage VX, the counter 40 will be reset. If capacitor C5 charges to voltage VX, the Schmitt trigger 56 will change output states and provide a ground or 0 logic state at the first input to NAND gate 60. The NAND gate 60 will provide a 1 logic state at its output and reset counter 40. However, if the touch plate 31 is actuated before the capacitor C5 charges to the voltage VX, the output of inverter 62 will be at the 0 logic state and capacitor C5 will discharge through resistor R6, diode D3 and inverter 62 to ground.

This sequence is repeated for the first, second and third touch pulses which provide a 1 logic state output at NOR gate 52. Thus, if the instrument player waits for a prolonged time period between the first and second or second and third or third and fourth taps of capacitive touch plate 31, the tempo generating device will automatically reset. Of course, this time interval is chosen to be of a duration greater than any musically desirable tempo. The fourth touch pulse will not provide a 1 logic state at the output of NOR gate 52 so the RC timing circuit of capacitor C5 and R5 will not be energized. However, the output of inverter 62 will be in the 1 logic state to discharge the voltage stored by capacitor C5 during the interval between the third and fourth touch pulses. Furthermore, the fifth touch of the capacitive touch plate 31 will provide a 0 logic state at the output of NAND gate 54 and a corresponding 1 logic state at the output of NAND gate 60 and the counter 40 will be reset.

Now, in response to the first touch pulse, the 1 logic state on counter line L1 is applied to inverter 42 and the 0 logic state output of inverter 42 is applied as the first input to NOR gate 58. The 0 logic state on counter output line L2 is applied as the second input to NOR gate 58. The 0 logic state on counter output line L3 is applied as the third input to NOR gate 58. The output of NOR gate 58 is in the 1 logic state and is applied to reset reversible counter 66.

Upon receipt of the second touch pulse from pulse generator 36, the output on line L1 to L3 of counter 40 are in the 0 1 0 logic state respectively. The 0 logic state on counter output line L1 is applied as the first input to NOR gate 64. The 1 logic state output on counter line L2 is inverted by gate 46 and applied as the second input to NOR gate 64. The 1 logic state output of NOR gate 64 is applied to open latching circuit 63 and places reversible counter 66 in the count-up mode. The reversible counter 66 and latch circuit 63 are well-known in the art and further description is unnecessary. The output of NOR gate 64 also sets bistable device 68 so that its output on line Q is in the 1 logic state. In the preferred embodiment, the bistable device 68 is a standard D-type flip-flop. The output of NOR gate 64 is also applied as the first input to NAND gate 70.

A clocking circuit 72 comprising oscillator 73 and divider 74 provides a signal to the second input of NAND gate 70. The clock operates at a frequency F and the divider circuit 74 provides a frequency signal at F/6. The third input to NAND gate 70 is normally in the 1 logic state. Thus, at the second touch pulse, the NAND gate 70 passes the clocking signal F/6 to the first input of NAND gate 76. The second and third inputs of NAND gate 76 are normally in the 1 logic state. The 1 logic states of NAND gate 76 are applied to the counting input of reversible counter 66. The reversible counter 66 continues to count up until it reaches its maximum or until the occurrence of the third touch pulse. Since subsequent operation of the circuit is similar for either event, it will be initially described as receiving the occurrence of the third touch pulse before the counter 66 reaches its maximum.

Upon the occurrence of the third touch pulse, the output lines L1 to L3 of counter 40 are in the 1 1 0 logic state. The 1 logic state on line L1 is applied to the first input of NOR gate 64 and the 1 logic state on line L2 via inverter 46 is applied as a 0 logic state to the second input of NOR gate 64. The output of NOR gate 64 is in the 0 logic state. The NAND gate 70 receives the 0 logic state output of NOR gate 64 and turns off, all its inputs not in the 1 logic state. Thus, the clocking signal from clock circuit 72 is not passed to the reversible counter 66. The 0 logic state output signal of NOR gate 64 also sets reversible counter 66 to the count-down state and closes latching circuit 63. The value of the count generated by the reversible counter 66 is now stored in latching circuit 63.

Upon the occurrence of the fourth touch pulse signal, the output lines L1 to L3 of the counter 40 are in the 0 0 1 logic state. The 1 logic state of counter output line L3 is applied as the first input to NAND gate 78. The second input to NAND gate 78 is in the 1 logic state from the Q line of bistable device 68. The third input to NAND gate 78 is the clocking signal frequency F/6 from the clocking circuit 72. The NAND gate 78 is on, all its inputs in the 1 logic state. The clocking signal at frequency F/6 is applied via NAND gate 76 to the count-down input of reversible counter 66. When the reversible counter 66 reaches its empty state, its output is in the 0 logic state. The output of reversible counter 66 is applied as the input to NOR gate 80. The NOR gate 80 acts as an inverter since one of its inputs is tied to ground. It should be noted that additional reversible counters and corresponding latching circuits can be added to increase the possible number of counts and the sensitivity of the tempo generating device. If a second reversible counter was used, its output lead would be connected to the second input of NOR gate 80.

If the circuit operation was still in the touch pulse two mode of operation and the reversible counter reached its maximum count, the output of reversible counter 66 would be in the 0 logic state. The 1 logic state output of NOR gate 80 is applied to inverter 82. The output of inverter 82 would then be in the 0 logic state and applied to the third input of NAND gate 70. Thus, if the reversible counter 66 reaches its maximum during the touch pulse two mode, the NAND gate 70 would turn off and no further clocking signal pulses from clocking circuit 72 would pass to the reversible counter 66.

In the fourth touch pulse mode, the 1 logic state output of NOR gate 80 is applied to the input of bistable device 84. The 1 logic state output on line L3 is applied to the other input of bistable device 84 during the fourth touch pulse mode. The bistable device can be a standard D-type flip-flop and operates as a monostable multivibrator. The output line $\overline{Q}$ is the 0 logic state and the output line Q is at the 1 logic state of bistable device 84. The 0 logic state on line $\overline{Q}$ is applied as the first input to NOR gate 86. The second input to NOR gate 86 is the 0 logic state of counter output line L3 via inverter 48. The 1 logic state output of NOR gate 86 resets the reversible counter 66 to the count value stored in latching circuit 63.

The 1 logic state output on line Q is applied at the C terminal input of bistable device 68. The output of bistable device 68 switches to a 0 logic state on line Q and a 1 logic state on line $\overline{Q}$. The NAND gate 78 is now off, all its inputs not in the 1 logic state. The $\overline{Q}$ output line of bistable device 68 is applied as the first input to NAND gate 88. The second input to NAND gate 88 is the one logic state of counter output line L3. The third input to NAND gate 88 is the clocking signal from clocking circuit 72 at frequency F. Thus, the clocking signal at frequency F is applied via NAND gate 76 to the reversible counter 66 to force the counter to count down at a higher frequency.

The 1 logic state signal on line Q of bistable device 84 via resistor R6 begins to charge capacitor C6. When the charge of capacitor C6 reaches the threshold of bistable device 84, the device is reset. However, before this occurs the 0 logic state on output line $\overline{Q}$ on bistable device 84 is applied to buffer circuit 90.

The buffer circuit 90 comprises resistors R7, R8 and R9 and transistor 91. The transistor 91 is normally on and a 0 voltage is at its collector due to the voltage drop or cross-resistor R9. The emitter of transistor 91 is coupled to ground. When the $\overline{Q}$ output line of bistable device 84 is in the 0 logic state and is applied to the base of transistor 91, the transistor 91 turns off and a positive V+ volts is present at this collector.

Thus, each time reversible counter 66 reaches its empty state, a pulse will appear at the collector of transistor 91. The pulse output signal of transistor 91 occurs at a spaced interval corresponding to the time period between the second and third touch pulses. In the preferred embodiment, the pulse output signal occurs at a frequency multiple of six times the desired tempo. This multiple is to render the pulse output compatible with other circuitry in the organ and it should be obvious to one of ordinary skill in the art that any multiple including a one-to-one correspondence could be chosen.

If the instrument player is in the process of playing and the tempo generating device is producing output pulses corresponding to one tempo and the player desires to select a different tempo, he taps the capacitive touch plate which provides the fifth pulse in the sequence. Upon the occurrence of the fifth touch pulse, the output lines of the counter 40 are in the 1 0 1 logic state. The 1 logic state output of line L1 is applied as the first input to NAND gate 54. The 1 logic state output of line L3 is applied as the second and third inputs to NAND gate 54. The output of NAND gate 54 is now in the 0 logic state. Upon receipt of the 0 logic state output of NAND gate 54, the output of NAND gate 60 changes to the 1 logic state and resets counter 40 to the 0 0 0 logic state. The player now repeats the four-step touch or tap sequence described above to set a new tempo.

It is to be understood that the above disclosure is to be interpreted in its broadest sense and is not to be limited to the specific embodiment disclosed.

I claim:

1. A tempo generating device for a rhythm instrument comprising:

a touch detector circuit repetitively actuatable by an instrument player at a desired tempo for producing touch control signals defining a time interval corresponding to said tempo;

a clock means for providing timing pulses;

a digital circuit having a memory energized by said touch control signals and responsive to said timing pulses for determining and retaining a digital value representative of said time interval and for repetitively producing output pulses; and generator means responsive to said repetitive output pulses from said digital circuit for producing tempo pulses spaced apart as a function of said time interval.

2. A tempo generating device as set forth in claim 1 wherein said digital circuit comprises:

a reversible counter circuit including a memory means energized by said touch control signals and responsive to said timing pulses for counting up to said digital value representative of said time interval and repetitively counting down to an empty state and for producing one of said output pulses upon the occurrence of said empty state.

3. A tempo generating device as set forth in claim 2 wherein said memory means comprises:

a latch circuit responsive to said touch control signals for retaining said digital value representative of said time interval and for reloading said counter circuit to said digital value upon the occurrence of said empty state so that said counter repetitively counts down to said empty state.

4. A tempo generating device for a rhythm instrument comprising:

a touch detector circuit repetitively actuatable by an instrument player at a desired tempo for producing touch control signals defining a time interval corresponding to said desired tempo;

a clock means for providing timing pulses;

a counter-decoder circuit responsive to said touch control signals for providing operation signals;

a control logic circuit coupled to said clock means and energized by said operation signals for passing said timing pulses for a period corresponding to said time interval;

a reversible counter circuit including a memory means and responsive to said passed timing pulses and said operation signals for counting up to a value representative of said time interval and repetitively counting down to an empty state and producing an output signal upon the occurrence of said empty state; and generator means responsive to said counter output signal for producing tempo output pulses spaced apart as a function of said time interval.

5. A tempo generating device as set forth in claim 4 wherein said memory means comprises:

a latch circuit responsive to said operation signals for retaining and counter value representative of said time interval and for reloading said counter to said value upon the occurrence of said empty state output signal so that said counter repetitively counts down to said empty state.

6. A tempo generating device as set forth in claim 5 wherein said generator means comprises:

a bistable device responsive to the occurrence of said empty state output signal from said counter for changing its output state; and a buffer circuit responsive to said change in output state for providing tempo output pulses spaced apart as a function of said time interval.

7. A tempo generating device as set forth in claim 6 wherein:

said clock means further provides an alternative timing pulse; and said control logic circuit responsive to the first said change in output state of said bistable device for passing said alternative timing pulse to said reversible counter so that said reversible counter counts down to said empty state at the frequency of said alternative timing pulse.

8. A tempo generating device as set forth in claim 7 wherein the frequency of said alternative timing pulse is a muliple of the frequency of said timing pulse.

9. A tempo generating device as set forth in claim 7 further comprising:

a reset circuit responsive to said operation signals and said touch control signals for providing a first signal to reset said counter-decoder circuit if the time duration between predetermined touch control signals exceeds a predetermined maximum and a second signal to reset said counter-decoder circuit upon the occurrence of a predetermined number of touch control signals.

10. A tempo generating device as set forth in claim 9 wherein said touch detector circuit comprises:

an oscillator for providing an output signal;

a switch means actuatable by an instrument player coupled to said oscillator for altering said oscillator output signal upon each actuation; and a sensor circuit coupled to said switch means and responsive to the alteration of said oscillator output signal for producing a pulse output corresponding to said switch means actuation.

11. A tempo generating device as set forth in claim 10 wherein said switch means comprises a capacitive touch plate for attenuating said oscillator output signal upon actuation.

12. A tempo generating device as set forth in claim 10 wherein said sensor circuit comprises:

a filter circuit coupled to said switch means for rejecting undesired frequency signals resulting from the switch actuation by the instrument player;

a rectifier circuit coupled to said filter circuit for providing a DC level signal output;

a differentiator circuit coupled to said rectifier circuit for detecting the occurrence of a change in said DC level signal output and producing a differentiated DC signal output; and a pulse generator responsive to said differentiated DC signal for producing a pulse output corresponding to said switch means actuation.

* * * * *